US011673186B2

(12) United States Patent
Ferrer

(10) Patent No.: US 11,673,186 B2
(45) Date of Patent: Jun. 13, 2023

(54) SEMI-CONTINUOUS CASTING OF AN INGOT WITH COMPRESSION OF THE METAL DURING SOLIDIFICATION

(71) Applicant: SAFRAN AIRCRAFT ENGINES, Paris (FR)

(72) Inventor: Laurent Ferrer, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/413,302

(22) PCT Filed: Dec. 13, 2019

(86) PCT No.: PCT/FR2019/053056
§ 371 (c)(1),
(2) Date: Jun. 11, 2021

(87) PCT Pub. No.: WO2020/120919
PCT Pub. Date: Jun. 18, 2020

(65) Prior Publication Data

US 2022/0062975 A1 Mar. 3, 2022

(30) Foreign Application Priority Data

Dec. 13, 2018 (FR) ..... 1872880

(51) Int. Cl.
*B22D 11/12* (2006.01)
*B22D 11/00* (2006.01)
(Continued)

(52) U.S. Cl.
CPC ..... *B22D 11/1206* (2013.01); *B22D 11/001* (2013.01); *B22D 11/041* (2013.01);
(Continued)

(58) Field of Classification Search
CPC . B22D 11/1206; B22D 11/001; B22D 11/041; B22D 11/126; B22D 11/181; B22D 21/005; B21B 1/46; B21B 1/463
See application file for complete search history.

(56) References Cited

U.S. PATENT DOCUMENTS 4,232,727 A * 11/1980 Bower ..... B22D 11/145
164/76.1

FOREIGN PATENT DOCUMENTS

DE 510361 C1 10/1930
EP 2 679 321 A1 1/2014
(Continued)

*Primary Examiner* — Kevin P Kerns
*Assistant Examiner* — Steven S Ha
(74) *Attorney, Agent, or Firm* — Birch, Stewart, Kolasch & Birch, LLP

(57) ABSTRACT

The invention relates to a method for manufacturing a metal ingot by continuous casting, comprising the following steps: S1: melting the metal, S2: transferring the liquid metal (2) by pouring it into a crucible (12), S3: moving the base plate (14) of the crucible (12), S4: progressive solidification of the liquid metal (2) from the base plate (14) of the crucible (12), and S5: during the step S3 of moving the base plate (14), applying a compression force to the metal (3) which is present between the base plate (14) and the side wall (13), the compression force being applied along a second axis (X2) parallel to the first axis (X1) so as to deform the metal and to obtain an ingot (3) which has a smaller width (L2).

8 Claims, 4 Drawing Sheets

(51) Int. Cl.

| | |
|---|---|
| ***B22D 11/041*** | (2006.01) |
| ***B22D 11/126*** | (2006.01) |
| ***B22D 11/18*** | (2006.01) |
| ***B22D 21/00*** | (2006.01) |

(52) U.S. Cl.
CPC ..... *B22D 11/126* (2013.01); *B22D 11/181* (2013.01); *B22D 21/005* (2013.01)

(56) References Cited

FOREIGN PATENT DOCUMENTS

| | | | | |
|---|---|---|---|---|
| GB | 1087154 | | | 10/1967 |
| JP | 57-175065 | A | | 10/1982 |
| JP | 63-33163 | A | | 2/1988 |
| JP | 1-306059 | A | | 12/1989 |
| JP | 06277809 | A | * | 10/1994 |
| JP | 3100491 | B2 | | 10/2000 |
| JP | 2013-111587 | A | | 6/2013 |

* cited by examiner

SEMI-CONTINUOUS CASTING OF AN INGOT WITH COMPRESSION OF THE METAL DURING SOLIDIFICATION

FIELD OF THE INVENTION

The invention relates to the manufacture, by semi-continuous casting, of metal ingots in particular in a titanium alloy or a titanium-based intermetallic alloy. More specifically, the invention relates to the non-optimization of the properties of use of finished products or products to be re-melted made from these metal materials.

TECHNOLOGICAL BACKGROUND

It is known to manufacture metal ingots by semi-continuous casting. Typically, this manufacturing method comprises the following steps:

Fusing the metal in one or several overflow basin(s) 10' from raw materials having either a chemical composition close to the composition desired in the end, or specific chemical compositions whose mixing leads to the desired composition.

Pouring the liquid metal 2' from the overflow basin(s) 10' into a bottomless crucible 12'. For that, the liquid metal 2' whose composition corresponds to the composition desired in the end flows from the last overflow basin into the crucible. The wall of the crucible 12' is generally made of copper, of copper alloy or of a material with high thermal conductivity and is cooled so as to be maintained at a temperature below the fusion or deterioration temperature of the material constituting it, for example by circulation of a fluid or a liquid at a defined thermostatically-controlled temperature. Copper pollution is possible on the surface, accentuating the core/skin chemical dispersion. In this crucible 12', the liquid metal 2' cools by extraction of the calories from the bottom (the crucible being devoid of a bottom) and solidifies as close as possible to the wall. The solidified metal 3' then acts as a container for the liquid metal 2' which continues to be poured gradually from the basins and its solidification front (corresponding to the boundary between the solidified metal 3' and the liquid metal 2' which forms a well) has a semi-ovoid to hemispherical shape.

The solidified metal 3' forms the metal ingot(s). Each ingot is gradually extracted from the crucible from the bottom using a sliding rod to maintain the liquid metal level in the crucible. For that, the rate of descent of the sliding rod is proportional to the rate of filling of the crucible with the liquid metal (or casting rate).

This method thus allows obtaining metal ingots.

However, it appears that the solidification macrostructure of the metal is very heterogeneous and anisotropic. The chemical composition of the metal is indeed dispersed. In addition, at the wall of the crucible, the dendritic grains tend to be equiaxed and in some cases, a segregated and positive exudation may occur. On the other hand, in the largest volume of the crucible, the dendritic grains are columnar or basaltic. More specifically, the solidification in semi-continuous casting leads to create solidification with columnar (or basaltic) grains in a direction perpendicular to the solidification front and which propagate towards the middle of the surface of the liquid well. The properties of the dendrites along the columns (or basalts) are however not the same as the properties transversely thereto so that a segregation is marked more fragile between each column or basalt.

During the machining in this columnar solidification structure, the response of the tools is therefore not the same depending on the angle of attack with respect to the axis of the dendrites. In addition, this laminated structure with two types of microstructures creates dispersion during the machining.

The use properties of the thus obtained ingots are therefore not optimized (the dimensioning being made from the minimum dimensioning curves taking into account the dispersion of the properties and of the responses to machining), insofar as residual porosities can be present in the raw solidification ingot. Furthermore, a dispersion of the responses to machining is obtained as well as a dispersion of the rheological laws and forgeability laws of the raw solidification microstructure in the three directions of the ingot and depending on the position in the ingot. When it is possible to convert (forging, rolling, stamping, extruding, etc.) the ingot in this raw solidification microstructure, heredity leads to a dispersion of the final microstructures on parts. However, in the case of ingots made from a titanium alloy or a titanium-based intermetallic alloy, the raw solidification microstructure does not allow realistic and economical forging because of their rheology and their forgeability. Finally, for ingot skin aspects, the casting rate is slow, which accordingly increases the manufacturing cost.

It has been proposed to carry out additional operations on the thus obtained ingots, depending on the application envisaged for the ingots.

For example, it has been proposed to apply to the ingots a heat treatment of hot isostatic pressing (or unidirectional hot pressing). Carrying out this operation however only allows removing the residual porosities of the raw solidification ingot but does not in any way modify the initial solidification macrostructure. In addition, this operation considerably increases the manufacturing cost as well as the industrial cycle time.

It has also been proposed to apply a heat treatment to the ingot in order to allow metallurgical transformations on a microscopic scale. However, this heat treatment does not modify the initial solidification macrostructure.

SUMMARY OF THE INVENTION

One objective of the invention is therefore to propose a method for manufacturing, by semi-continuous casting, a metal ingot in particular in a titanium alloy or a titanium-based intermetallic alloy, whose macrostructure is more uniform and more isotropic than the columnar macrostructure obtained in the conventional manufacturing methods, which would be simple to carry out at a moderate cost.

For that, the invention proposes a method for manufacturing a metal ingot by continuous casting, comprising the following steps:

S1: fusing all or part of the metal so as to obtain liquid metal,

S2: transferring the liquid metal by flowing it into a crucible, said crucible having a base plate and at least one side wall together delimiting an enclosure configured to receive the liquid metal, the side wall having a first width along a first axis,

S3: moving the base plate relative to the side wall at a controlled rate depending on a rate of flow of the liquid metal, and S4: gradually solidifying the liquid metal from the base plate of the crucible.

Furthermore, during step S3 of moving the base plate, the method further comprises a step S5 of applying a compressive force to the metal which is present between the base plate and the side wall, said compressive force being applied along a second axis parallel to the first axis so as to deform said metal and to obtain an ingot with a second width along this first axis which is smaller than the first width.

Some preferred but non-limiting characteristics of the manufacturing method described above are as follows, taken individually or in combination:

- during step S5 of applying the compressive force, the metal is solidifying.
- the manufacturing method further comprises, after step S5, at least one additional step of applying to the ingot a compressive force along a third axis so as to deform it and to obtain an ingot with a third width along this third axis, the third width being smaller than the second width.
- the manufacturing method further comprises, during step S5, the application of an additional compressive force to the metal which is present between the base plate and the side wall along an axis which is secant with the first axis.
- during step S5, the base plate is also deformed and the manufacturing method further comprises a subsequent step of cutting the base plate.

According to a second aspect, the invention proposes a tool for the manufacture of a metal ingot by semi-continuous casting in accordance with a manufacturing method as described above, said tool comprising the following elements:

- an overflow basin configured to fuse the liquid metal so as to obtain metal,
- a crucible having a base plate and at least one side wall together delimiting an enclosure configured to receive the liquid metal, the side wall having a first width along a first axis,
- an actuator configured to move the base plate of the crucible relative to the side wall of the crucible at a controlled rate depending on a rate of flow of the liquid metal,
- means for gradually solidifying the metal, and
- deformation means configured to apply a compressive force to the metal which is present between the base plate and the side wall, said compressive force being applied along a second axis parallel to the first axis so as to deform said metal and to obtain an ingot with a width along this first axis which is smaller than the first width.

Some preferred but non-limiting characteristics of the tool described above are as follows, taken individually or in combination:

- the tool further comprises additional deformation means extending in the same plane as the deformation means and configured to apply a compressive force simultaneously with the metal.
- the tool further comprises additional deformation means extending downstream of the deformation means and configured to apply a compressive force to the metal at the outlet of the deformation means.
- the deformation means comprise at least one of the following elements: a press, a rolling mill.
- a groove is formed in a deformation surface of the deformation means in order to constrain the volume of the metal.

BRIEF DESCRIPTION OF THE DRAWINGS

Other characteristics, aims and advantages of the present invention will become more apparent upon reading the following detailed description, and in relation to the appended drawings given by way of non-limiting examples and in which.

DETAILED DESCRIPTION OF ONE EMBODIMENT

Figure 1:
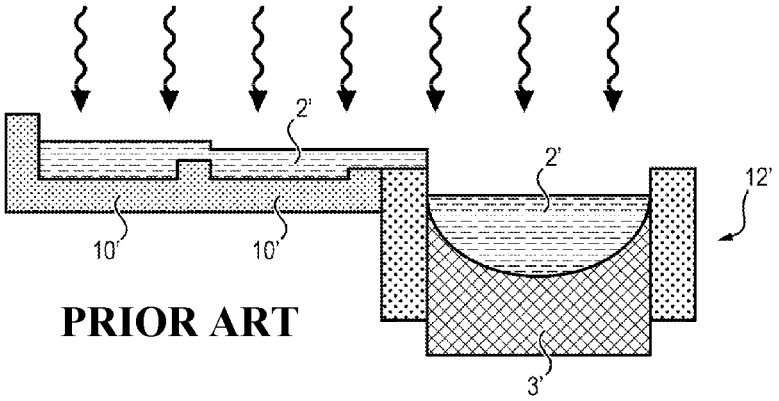
FIG. 1 illustrates a conventional semi-continuous casting manufacturing method.
Figure 2:
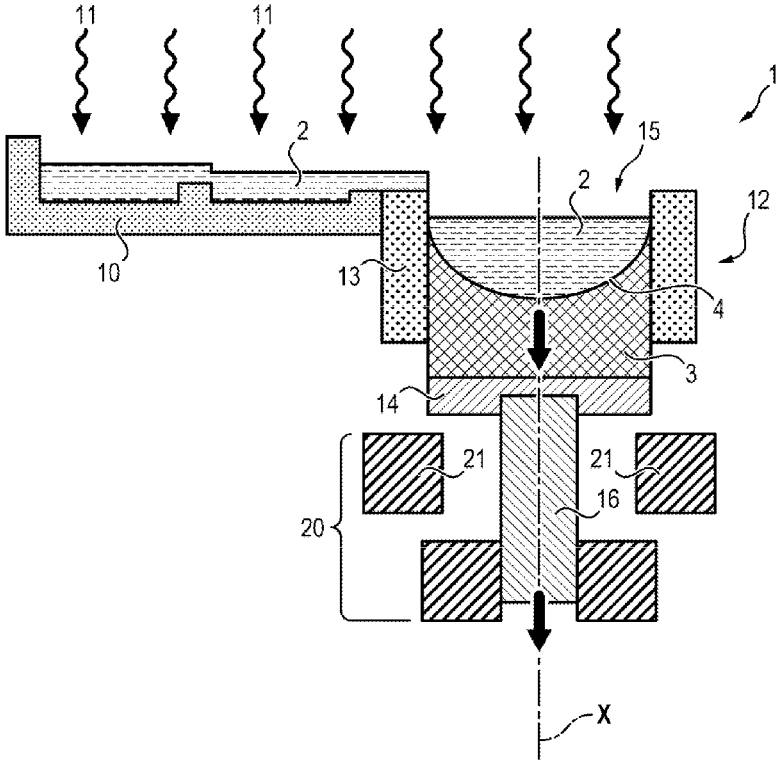
FIG. 2 illustrates an example of a tool that can be implemented in a semi-continuous casting manufacturing method in accordance with an exemplary embodiment of the invention, before the application of compressive forces to the intermediate ingot.

The invention proposes to make a metal ingot by semi-continuous casting, by application of compressive forces to the metal during solidification 3 in order to break the dendrites for obtaining grains whose three-dimensional structure is improved (recrystallization into equiaxed grains). This hot-shaping therefore allows, in a simple and inexpensive manner, significantly improving the properties of the material and the final machining conditions.

The metal can in particular comprise a titanium-based alloy or a titanium-based intermetallic composite.

The titanium-based alloy may for example comprise one at least of the following alloys: Ti17 (Ti-5Al-2Sn-2Zr-4Mo-4Cr), TiBeta16, Ti21S (Ti-15Mo-3Nb-3Al-0.2Si, ASTM Grade 21), Ti6242 (Ti-6Al-2Sn-4Zr-2Mo), Ti6246 (Ti6Al-2Sn-4Zr-6Mo), Ti5553 (Ti-5Al-5Mo-5V-30r), Ti1023 (Ti-10V-2 Fe-3Al), TA6V (Ti-6Al-4V), etc.

The intermetallic alloy may for example comprise a titanium-based intermetallic alloy, including in particular titanium aluminides, among which:

- titanium aluminides with $\gamma$ and columnar $\alpha 2$ phases, such as: Ti-48Al-1V-0.30, Ti-48Al-2Cr-2Nb (also known as "GE 48-2-2") or Ti-48Al-2Nb-0.75Cr-0.3Si (also known as "Daido RNT650");
- titanium aluminides with $\gamma$ and equiaxed $\alpha 2$ phases, such as Ti-45Al-2Nb-2Mn+0.8TiB2 (also known as "Howmet 45XD"), Ti-47Al-2Nb-2Mn+0.8TiB2 (also known as "Howmet 47XD"), Ti-47Al-2W-0.5Si-0.5B (also known as "ABB-23") or Ti-48Al-1.3Fe-1.1V-0.3B,
- aluminides with $\beta$, $\gamma$ and equiaxed $\alpha 2$ phases, such as Ti-47.3-Al-2.2Nb-0.5Mn-0.4W-0.4Mo-0.23Si, Ti-46.5Al-3Nb-2Cr-0.2W-0.2Si-0.1C (also known as "K5SC"), Tl-46Al-5Nb-1W, Ti-47Al-3.7(Cr,Nb,Mn, Si)-0.5B (also known as "GKSSTAB"), Ti-45Al-8(Nb, B,C) (also known as "GKSS 20 TNB"), Ti-46.5Al-1.5Cr-2Nb-0.5Mo-0.13B-0.30 (also known as "395M"), Ti-46Al-2.5Cr-1Nb-0.5Ta-0.01B (also known as "Plansee γ-MET"), Ti-47Al-1Re-1W-0.2Si (also known as "Onera G4"), Ti-43Al-9V-0.3Y, Ti-42Al-5Mn, Ti-43Al-4Nb-1Mo-0.1B, or Ti-45Al-4Nb-4Ta.25

It should be specified that in the list above, all the numerical values denote the atomic percentage (at %) of the element that they precede. Thus, the alloy Ti-48Al-2Cr-2Nb comprises, in atomic percentage, 48% Al, 2% Cr, 2% Nb, and titanium (Ti) to make up to 100%.

In the following, it will be meant by "intermediate ingot 3", the solidifying metal portion 3 to which the compressive forces are applied, and by "final ingot" the portion of liquid metal 2 at the outlet of the tool 1.

During a first step S1, the liquid metal 2 is melted so as to obtain the liquid metal 2.

This step can be carried out conventionally in a tool 1 comprising one or several overflow basin(s) 10 from raw materials having either a chemical composition close to the composition desired in the end, or specific chemical compositions.

The overflow basin(s) 10 may be made from a material comprising copper, a copper alloy or any other material with high thermal conductivity. Each overflow basin 10 is maintained at a temperature below the fusion or deterioration temperature of the material constituting it, for example by circulation of a fluid or a liquid such as water at a defined thermostatically-controlled temperature.

The fusion of the raw materials in order to obtain the molten liquid metal 2 can be performed by any heating means 11, such as for example using at least one of the following heating means: electric arcs, by induction, by plasma arc and/or by electron bombardment.

For example, the industrial means that can be used for this fusion comprise a vacuum-induction or partial-pressure melting furnace, a pressure-controlled plasma arc melting furnace (known as PAM furnace), a vacuum electronic bombardment melting furnace (known as EB furnace), or a melting furnace combining several of these heating means.

Furthermore, the atmosphere can be controlled based on the applications chosen for the final ingot. Thus, during the fusion step S1, the furnace can be placed under vacuum in order to avoid any chemical reaction with the molten liquid metal 2. Alternatively, the furnace can be placed under controlled pressure of inert gas, in order to avoid any chemical reaction with the molten liquid metal 2. In yet another variant, the furnace can be placed under controlled pressure of specific gas to allow a chemical reaction with the liquid metal and charge the chemical composition of the alloy with this gaseous element.

This first step S1 of fusing the metal being conventional, it will not be detailed further here.

During a second step S2, the thus obtained liquid metal 2 is transferred by flow into a crucible 12, either directly from the first overflow basin 10, or via one or several intermediate overflow basin(s) 10, for example by spillage.

The crucible 12 comprises a base plate 14 and at least one side wall 13 together delimiting an enclosure configured to receive the liquid metal 2.

The shape of the crucible 12 depends on the shape of the final ingot sought to be obtained. The side wall 13 of the crucible 12 can therefore comprise only one side, in the case where the crucible 12 is of circular or curved section, or several sides in the case of a parallelepiped-shaped crucible 12 or any other shape.

A maximum width of this side wall 13 is equal to a first width L1. By width, it is meant here the distance between two parallel straight lines (or "support lines") which are tangent to the closed curve formed by the inner face of the side wall 13 radially delimiting the enclosure at two distinct points. The maximum width then corresponds to the greatest width of the inner face delimiting the enclosure. For example, in the case of an enclosure of circular section, the maximum width is equal to the diameter of the circle. Alternatively, in the case of an enclosure of polygonal section, the maximum width corresponds to the diagonal of the polygon.

The base plate 14 is configured to sealingly close the crucible 12 and prevent leakage of liquid metal 2. For that, the base plate 14 can be wider than the side wall 13 and abut against its lower face so to form a tight seal. Alternatively, the base plate 14 can enter in a fitted manner the enclosure. The width of the base plate 14 is then substantially equal to the width of the side wall 13 at any point of its circumference so that the base plate 14 comes into surface contact with the inner face of the side wall 13, the contact forming a tight seal. The width of the base plate 14 at the first axis X1 is moreover equal to the first width L1.

The base plate 14 is preferably made of copper, copper alloy, aluminum, aluminum alloy, or any other material with high thermal conductivity and deformable at the fusion temperature of the liquid metal 2. In this way, the base plate 14 diffuses the heat from the metal, thus facilitating its cooling and the formation of the solidification front 4. Where appropriate, the base plate 14 can be sprayed or sprinkled with a cooling fluid, such as water.

Where appropriate, the base plate 14 can be covered with a film forming a diffusion barrier in order to prevent the diffusion of the chemical elements of the base plate 14 towards the metal.

During a third step S3, the base plate 14 of the crucible 12 is moved along a longitudinal axis X relative to the side wall 13 at a controlled rate depending on a rate of flow of the liquid metal 2 so as to draw the metal 3 outside the crucible 12. For that, an actuator is fixed on the base plate 14 so as to allow its drawing along a longitudinal axis X which is normal to the base plate 14.

The actuator can for example be fixed on a rod 16 coaxial with the longitudinal axis X, the rod 16 being itself fixed on the plate in order to move the plate along said axis X.

Conventionally, the rate of descent of the base plate 14 is proportional to the rate of casting in order to maintain the level of liquid metal 2 in the crucible 12.

During a fourth step S4, which is concomitant with the third step S3, the liquid metal 2 gradually solidifies. The solidification starts at the base plate 14 and gradually propagates in the direction of the mouth 15 of the crucible 12 through which the liquid metal 2 is transferred. The liquid metal 2 solidifies as close as possible to the side wall 13 and to the base plate 14, and the solidification front 4 gradually moves away from the base plate 14 as it is moved. The solidified metal 3 then acts as a container for the liquid metal well 2.

For that, the side wall 13 and the base plate 14 can be cooled in a conventional manner, for example by circulation of a fluid or a liquid such as water at a defined thermostatically-controlled temperature. Furthermore, the liquid metal 2 also solidifies between the base plate 14 and the side wall 13 and forms a sealing with the side wall 13, thus preventing any leakage of liquid metal 2.

During a fifth step S5, concomitantly with step S3 of moving the base plate 14, a compressive force is applied at least once to the metal during solidification 3 (hereinafter, intermediate ingot) in order to break the dendrites.

For that, the tool 1 comprises deformation means 20 configured to apply compressive forces to the intermediate ingot 3. These deformation means 20 may in particular comprise one or several press(es) 21 and/or one or several rolling mill(s) 20. The press(es) 20 and the rolling mill(s) 20 are then distributed about the longitudinal axis X along one or several row(s) (depending on whether the solidifying metal 3 receives one or several successive compressive force(s)).

Preferably, the tool 1 comprises at least two rows in series of deformation means 20 along the longitudinal axis X.

It will be noted that, during this step S5, the metal 3 to which the compressive force is applied must be solidifying but must not yet be solidified. It must be in a phase comprising both liquid metal and solid metal (also referred to as "forged molten" phase), in which the porosity of the metal is better than when it is in the solid state. It will be particularly noted that, in the liquid and solid well, there is a wide range of temperatures (temperature gradient), the hottest areas being at the central surface of the liquid and the coldest areas being in cooled solid skin. In an alloy, the transitions from the solid state to the liquid state (and vice versa) do not take place at an accurate temperature but within a range of temperatures. Metal 3 is 100% in the solid state and its temperature is locally lower than a temperature called Solidus. Liquid Metal 2 is 100% in the liquid state and its temperature is above a temperature called Liquidus. Between these two states, the metal is said to be pasty (forged molten phase) with a liquid and solid mixture with a temperature comprised between Solidus and Liquidus. During the first compression steps, the maximum of this area under the hammers or working rolls is sought.

Step S5 is therefore not a hot static compression.

For that, the temperature of the ingot during step S5 is heterogeneous and comprised in a temperature gradient between the cooled skin of the metal 3 at a temperature significantly lower than the Solidus to core temperature at a temperature desired to be higher than the Solidus temperature (a portion of pasty metal taken under compression). Preferably, the core temperature is higher than the Liquidus temperature. In addition, it should be noted that under the deformation related to compression, there is a heating called adiabatic heating which increases the temperature, especially as the temperature is low. This is true for the first stages of the deformation means 20 (that is to say the first sets of hammers or rolls). For the other stages, the temperature of the core may be lower than the solidus temperature.

Figure 3:
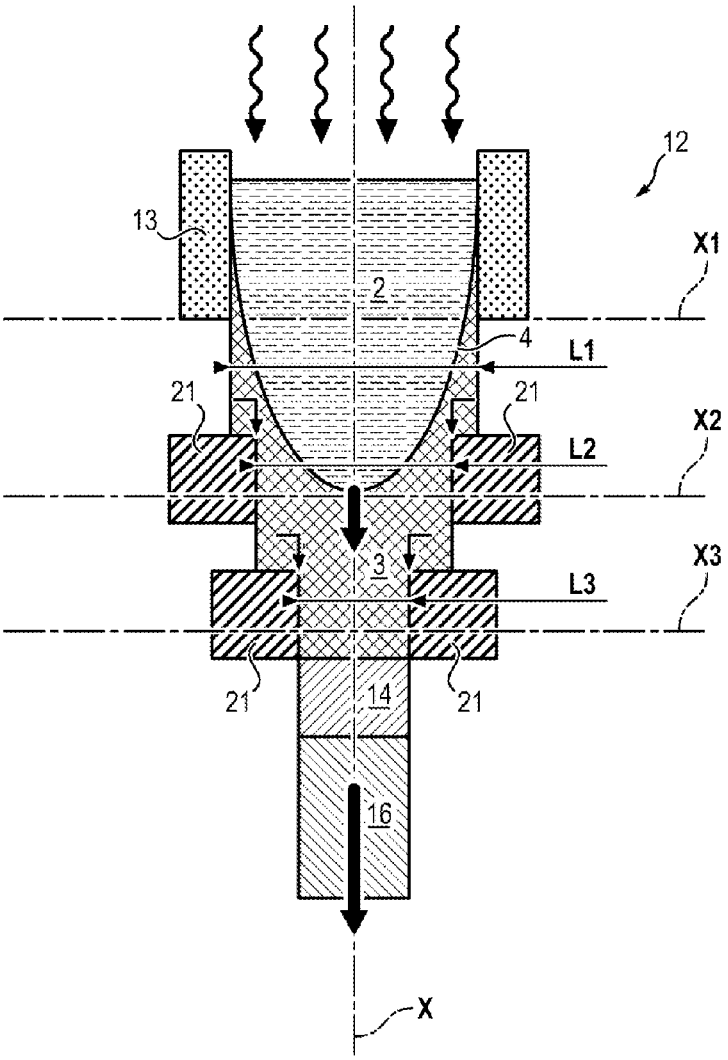
FIG. 3 illustrates the tool of FIG. 2 during the application of compressive forces to the intermediate ingot using presses.
Figure 4:
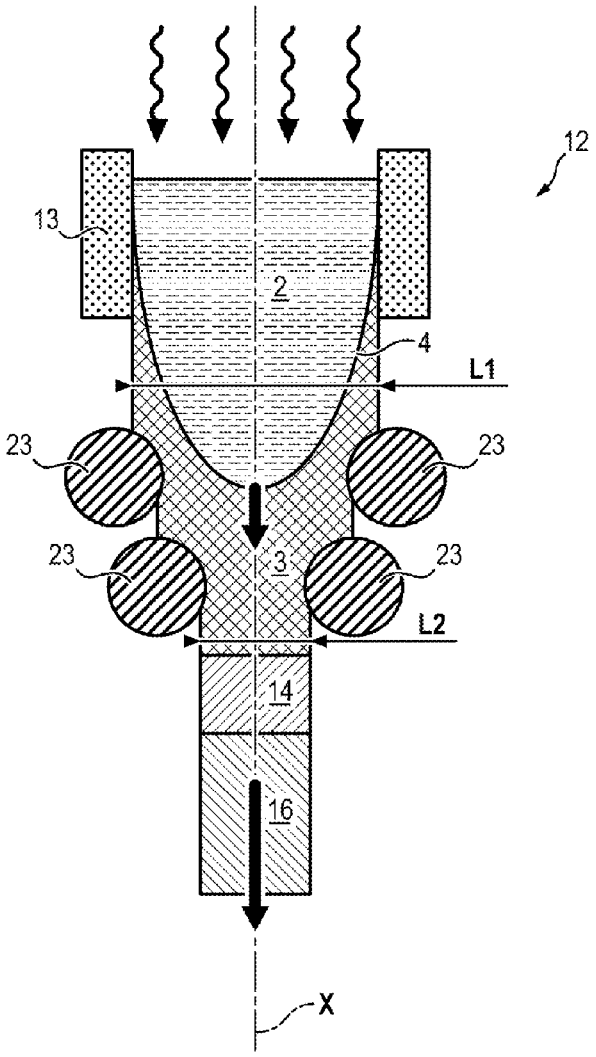
FIG. 4 illustrates a second example of a tool that can be implemented in a semi-continuous casting manufacturing method in accordance with an exemplary embodiment of the invention, during the application of compressive forces to the intermediate ingot using rolling mills.
Figure 5:
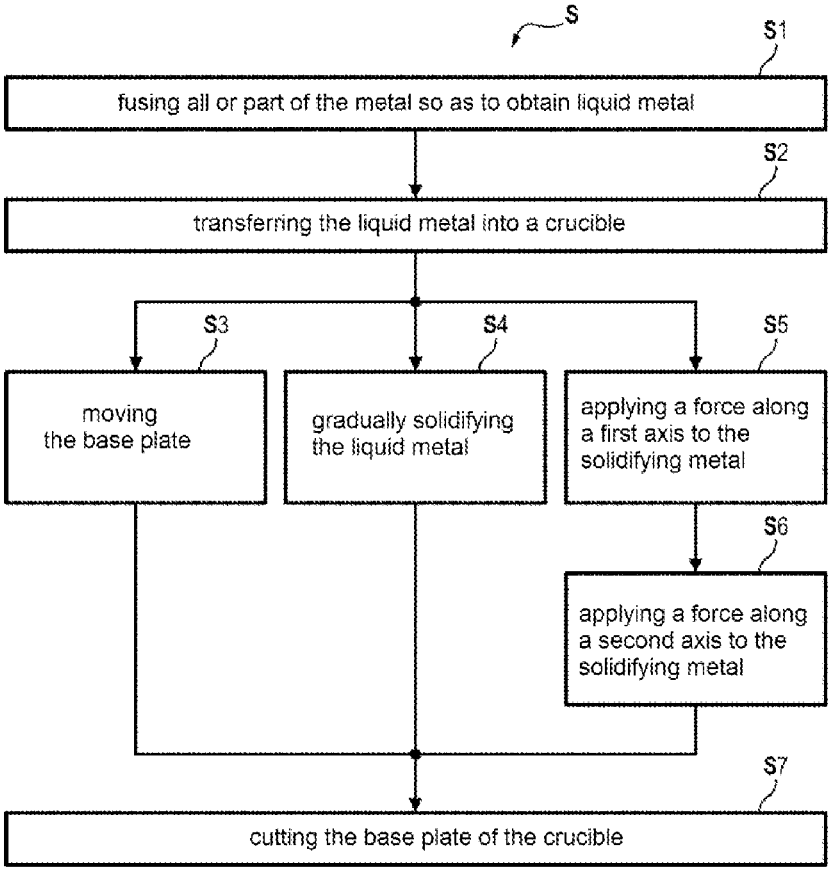
FIG. 5 is a flowchart illustrating the steps of one exemplary embodiment of a semi-continuous casting manufacturing method in accordance with the invention.

During step S5, the compressive force is applied perpendicularly to the longitudinal axis X, along a direction parallel to the first axis X1 so as to deform the metal and obtain an intermediate ingot 3 with a second width L2 along this direction which is smaller than the first width L1. Where appropriate, a second compressive force can further be applied:

- either simultaneously, in the same plane as the first axis X1, along an axis which is secant with the first axis X1 (not illustrated in the figures),
- or successively, downstream, along an axis which may be parallel to the first axis X1 (step S6—see axes X2 and X3 in FIGS. 3 and 4).

These steps S5, S6 allow breaking the columns and the basalts during the solidification of the metal 3 while it is still in the semi-liquid (pasty) phase, causing an equiaxed recrystallization in the intermediate ingot 3 and improving the surface condition of the skin of the final ingot. Furthermore, it is possible to increase the casting rate in comparison with the prior art by increasing the drawing rate of the actuator, thereby reducing the total fusion time as well as the manufacturing cost of the final ingots.

Preferably, at least two successive compressive forces are applied to the metal during solidification 3, in order to obtain a final ingot having a macrostructure whose grains are equiaxed. The final ingot then has a third width L3, which is smaller than the first and the second width L1, L2.

In the case where the deformation means 20 comprise at least one press, each press 20 comprises a pair of hammers 21 placed opposite each other and moving along the same direction intersecting the longitudinal axis X and whose motion is synchronized. Where appropriate, several pairs of hammers 21 can extend in the same plane and together form a single row. The pairs of hammers 21 of the same row can then be synchronized so as to simultaneously apply the compressive force to the opposite intermediate ingot 3 and thus constrain its volume.

When at least two successive compressive forces are applied to the intermediate ingot 3 by presses 20, the pairs of hammers 21 extend in parallel planes each forming a row.

It will be understood that the tool 1 can comprise a number greater than or equal to two pairs of hammers 21, the number of hammers 21 always being an even number.

During step S5, each pair of hammers 21 is moved along the longitudinal axis X at the same rate as the base plate 14 in order to follow the intermediate ingot 3 during the application of the compressive force and eject it downwards, before returning to its initial position in order to apply the compressive force to the following intermediate ingot 3 (which is located immediately above the one that has just been compressed). Preferably, the rate of movement along the longitudinal axis X of the hammers 21 is substantially equal to the casting rate during the application of the compressive force.

Each press 20 can be mechanical, hydraulic or mixed.

In the case where the deformation means 20 comprise at least one rolling mill, each rolling mill 20 comprises two rollers 23 opposite each other extending along the first axis X1. Where appropriate, several pairs of rollers 23 can extend in the same plane and together form a single row. The pairs of rollers 23 in the same row can then be positioned so as to constrain the volume of the intermediate ingot 3.

When at least two successive compressive forces are applied to the intermediate ingot 3, the pairs of rollers 23 may extend in parallel planes each forming a row.

It will be understood that the tool 1 can comprise a number greater than or equal to two pairs of rollers 23, the number of rollers 23 always being an even number.

During step S5, the rate of rotation of the rollers 23 is chosen so that their rolling surface follows the intermediate ingot 3 during the application of the compressive force and so that said ingot is ejected downwards. Where appropriate, the rate of each pair of rollers 23 can be adapted analogously to what is already done in the case of two-high rolling lines. More specifically, in the case of the two-high rolling, two cylindrical or diabolo rollers of a rolling mill work both in force and in deformation. The air gap between the rollers is fixed and their rotation causes the running. The rollers are cooled with water.

Figure 6:
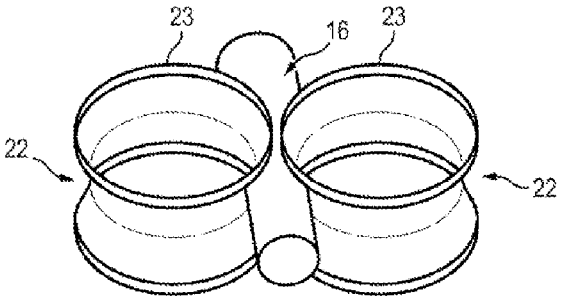
FIG. 6 illustrates an example of rollers in which a groove is formed.

Whatever the alternative embodiment, a groove 22 can be formed in the application surface of the compressive force of each hammer 21 and of each roller 23 so as to constrain the volume of the intermediate ingot 3 (see FIG. 6). In other words, the intermediate ingot 3 is forced to lengthen along the longitudinal axis X, the groove 22 being shaped so as to reduce its section and its width by preventing its expansion in a plane radial to the longitudinal axis X. The shape and dimensions of the groove 22 are chosen based on the shape and dimensions of the side wall 13 of the crucible 12 and on the shape (round, square, rectangular, prismatic section, any profile, etc.) and dimensions desired for the final ingot.

Alternatively, when several pairs of deformation means 20 are placed in the same plane normal to the longitudinal axis X, said deformation means 20 are positioned relative to the intermediate ingot 3 so that their application surface forms a spout (whose shape and dimensions depend on those of the side wall 13 of the crucible 12 and on the final ingot), in order to constrain the volume of said intermediate ingot 3 and guarantee its longitudinal deformation.

The deformation means 20 are preferably cooled and lubricated, for example with water.

Where appropriate, the tool 1 can further comprise one or several heating means, extending at the deformation means 20, in order to improve the control of the temperature of the intermediate ingot 3, to increase the rolling temperature and to reduce the stresses at the deformation means 20.

The rate of movement of the deformation means 20 (translation of the hammers 21 and rotation of the rollers 23) is adjusted so as to guarantee a homogeneous application of the compressive force to the intermediate ingot 3. Any section of the solidifying metal 3 derived from the enclosure is therefore compressed during step S5.

In one embodiment, the base plate 14 is also deformed during step S5 in order to guarantee that all the metal exiting the enclosure is well compressed by the deformation means 20 (see FIGS. 3 and 4). This further allows simplifying the method S since it is not necessary to space apart the hammers 21 or the rollers 23 to avoid deforming the base plate 14 and allow its passage.

Where appropriate, the tool 1 may comprise a probe configured to detect the stresses generated on the first row, and therefore the arrival of the base plate 14 at the deformation means 20.

It will be noted that the casting rate can be increased from the moment the base plate 14 arrives at the first row of press(es) 20 and/or rolling mill(s) 20, so that the depth of the liquid metal well 2 can be closest to the air gap of the first row and thus guarantee that the metal of the intermediate ingot 3 is indeed in the semi-liquid phase. Typically, the casting rate can be increased when the probe detects the stresses generated on the first row of rollers 23 or hammers 21.

In one embodiment, the deformation means 20 may form all or part of the actuator and be used to move the base plate 14 and the solidifying metal 3 downwards during step S3. To this end, the air gap of the means for moving the most downstream row may be substantially equal to the width of the rod 16. The width and the shape of the rod 16 are therefore substantially identical to the width and to the shape of the final ingot.

Alternatively, the actuator may comprise a specific mechanism configured to move the rod 16 until the base plate 14 reaches the first row of deformation means 20. Then, where appropriate, this specific mechanism may be disengaged from the rod 16, the role of the actuator being taken over by the deformation means 20 so that the movement of the rod 16 is performed simultaneously with the movement (translation of the hammers 21 or rotation of the rollers 23) of the deformation means 20.

In the case of a rolling mill 20, it will be noted that, for a round-bar type ingot, the rate $V_1$ of the metal at the outlet of the tool 1 is determined as a function of the final radius $R_1$ sought for the ingot 3, on the initial radius $R_0$ of the ingot and on its casting rate $V_0$ (at the mouth 15 of the tool 1):

$$V_1=V_0*R_0^2/R_1^2$$

In the case where the ingot has any initial section $S_0$ and any final section $S_1$, the rate $V_1$ at the outlet of tool 1 is then defined as follows:

$$V_1=V_0*S_0/S_1$$

In general, when the tool 1 comprises several stages of rolling mills 20, the rate $V_n$ of the ingot 3 at the outlet of the stage n of the rolling mill 20 is defined as follows:

$$V_n=V_{n-1}*S_{n-1}/S_n.$$

In a manner known per se, the rate of rotation of the rollers n is then determined by taking into account the smallest radius of the diabolo-shaped roller, the rate $V_n$ of the ingot 3 at the outlet of the stage n of rollers and a factor that takes into account the temperature slip to be defined by tests.

In the case of a press 20, which achieves two motions simultaneously (a longitudinal movement VL in the long direction and a radial movement to deform the material at a given rate VR), the radial pressure of a hammer 21 of a given stage n, whose contact area is A, causes a movement of the material up and down at a rate equal to:

$$A/(S_{n-1}+S_n)*VR*Cste$$

where: Cste is a constant as a function of the temperature and of the slip to be defined by tests.

In order to guarantee the same casting rate $V_0$ in the crucible in the longitudinal direction, the rate VL of the hammers 21 of stage n must be equal to:

$$VL=V_{n-1}+N*A/(S_{n-1}+S_n)*VR*Cste$$

where: N is the number of hammers per stage.

The rate $V_n$ of the ingot 3 at the outlet of the stage is therefore:

$$V_n=VL+N*A/(S_{n-1}S_n)*VR*Cste$$

The pressure applied by the hammers 21/rollers 23 is determined based on the air gaps, on the section ratios of the ingot 3 ($S_{n-}/S_n$) and on the flow stresses in order not to reach the maximum power of the presses or the rolling mill. 20. In general, the average flow stress depends on the average temperature (between the core and the periphery) and on the deformation rate as a function of the rates above.

The method S of the invention allows reducing the very heterogeneous macrostructures related to the columnar solidification, to the positive segregations and to the aligned segregations obtained with the conventional semi-continuous castings. The properties of the final ingot are significantly improved, as well as the machining conditions of this raw solidification structure. Particularly:

- The elimination of the columnar grains makes the mechanical and dynamic properties isotropic, with the same properties along a direction perpendicular to the solidification front 4 and along a direction parallel thereto.
- The elimination of the columnar grains makes the machining compressive forces isotropic along these same directions. The machining stress relaxations are also more isotropic, which reduces the dispersion of the deformations of the parts, simplifies the machining ranges, reduces the manufacturing cost and reduces the manufacturing cycle time.
- The elimination of the aligned positive segregations reduces the dispersion of the use properties of the machining conditions, improves the dimensioning and reduces the risks of dimensional scrap.

The elimination of the exudation on the surface of the ingot, during solidification, also reduces the dispersion of the properties and of the machining conditions.

The method S allows obtaining ingots that can be transformed so as to obtain:

semi-finished products in bars or billets whose use properties can be improved by 15%. Once cooled, the final ingots are hot-deformed by rolling, forging, stamping, extruding, etc. in order to form bars or billets for a subsequent cold or hot deformation and/or a machining.

foundry bars, solidification raw ingots, whose dispersion of the use properties and of the responses to machining are significantly improved. Particularly, the hot isostatic treatment can be eliminated before machining.

slugs or blanks, solidification raw ingots. Once cooled, the final ingots are cut into slugs or blanks and can be hot-deformed as close as possible to the sides of the final part by forging, rolling, stamping, extruding, etc. without dispersion of the final microstructures on the part.

The invention claimed is:

1. A manufacturing method comprising:

fusing metal so as to obtain liquid metal;

transferring the liquid metal by flowing it into a crucible, the crucible having a base plate and a side wall together delimiting an enclosure configured to receive the liquid metal, the side wall having a first width along a first axis;

moving the base plate relative to the side wall at a controlled rate depending on a rate of flow of the liquid metal and, while the base plate is moving relative to the side wall, applying a compressive force to the base plate and to the liquid metal which is present between the base plate and the side wall, the compressive force being applied along a second axis parallel to the first axis so as to deform the liquid metal and the base plate to obtain a metal ingot with a second width along this first axis which is smaller than the first width and a deformed base plate;

after obtaining the metal ingot with the second width, applying to the metal ingot an additional compressive force along a third axis so as to deform the liquid metal to and reduce the width of the metal ingot to a third width along this first axis, the third width being smaller than the second width;

gradually solidifying the liquid metal from the base plate of the crucible; and cutting the base plate.

2. The manufacturing method according to claim 1, wherein, during the moving step, the liquid metal is solidifying.

3. The manufacturing method according to claim 1, further comprising, during the moving step, applying an additional compressive force to the liquid metal which is present between the base plate and the side wall along an axis which is secant with the first axis.

4. A tool for the manufacture of a metal ingot by semi-continuous casting comprising:

an overflow basin configured to fuse metal so as to obtain liquid metal;

a crucible having a base plate and a side wall together delimiting an enclosure configured to receive the liquid metal, the side wall having a first width along a first axis;

an actuator configured to move the base plate of the crucible relative to the side wall of the crucible at a controlled rate depending on a rate of flow of the liquid metal;

a first deformation means configured to apply a compressive force to the base plate and to the liquid metal which is present between the base plate and the side wall, the compressive force being applied along a second axis parallel to the first axis so as to deform the liquid metal and the base plate and to obtain a metal ingot with a width along this first axis which is less than the first width and a deformed base plate; and a second deformation means configured to apply a compressive force to the liquid metal which is present between the base plate and the sidewall, the compressive force being applied along a third axis so as to deform the liquid metal and to obtain a metal ingot with a width along the third axis which is less than the second width.

5. The tool according to claim 4 further comprising additional deformation means extending in the same plane as the first deformation means and configured to simultaneously apply a compressive force to the liquid metal.

6. The tool according to claim 4 wherein the second deformation means are located downstream of the first deformation means and configured to apply a compressive force to the liquid metal at an outlet of the first deformation means.

7. The tool according to claim 4, wherein the first deformation means comprise at least one of the following elements: a press and a rolling mill.

8. The tool according to claim 7, wherein a groove is formed in a deformation surface of the first deformation means in order to constrain the volume of the metal.

* * * * *